US005337636A

United States Patent [19]

Shea

[11] Patent Number: 5,337,636

[45] Date of Patent: Aug. 16, 1994

[54] AUTOMATIC SCREW FEEDER

[76] Inventor: Reeford P. Shea, 1021 Goldenrod Ave., Corona del Mar, Calif. 92625

[21] Appl. No.: 47,645

[22] Filed: Apr. 13, 1993

[51] Int. Cl.[5] ..... B25B 23/06

[52] U.S. Cl. ..... 81/435; 221/220

[58] Field of Search ..... 81/57.37, 434, 435; 206/343-347; 221/210, 220

[56] References Cited

U.S. PATENT DOCUMENTS

| | | | |
|---|---|---|---|
| 3,930,297 | 1/1976 | Potucek et al. | 81/434 X |
| 4,014,225 | 3/1977 | Lejdegard et al. | 81/434 |
| 4,146,071 | 3/1979 | Mueller . | |
| 4,517,863 | 5/1985 | Ishikawa | 81/434 |
| 4,602,537 | 7/1986 | Dixon | 81/435 X |
| 4,667,545 | 5/1987 | Gould et al. | 81/57.37 |
| 5,027,679 | 7/1991 | Kawashima et al. | 81/434 |
| 5,083,483 | 1/1992 | Takagi | 81/434 |
| 5,239,900 | 8/1993 | Macris | 81/435 |

OTHER PUBLICATIONS

Quick Drive Fastening Systems, Model QD 3301 advertising sheet (undated).

Duo-Fast Self-Feeding Screwdriver, Models TD-162 and TD-16251 advertising sheet (Mar. 1988).

Rocker Auto/Screw Converter advertising sheet (1992).

*Primary Examiner*—James G. Smith

*Attorney, Agent, or Firm*—Hawes & Fischer

[57] ABSTRACT

An automatic screw feeder to be coupled to a conventional electric screw driver so that a plurality of screws may be successively and automatically grasped and relocated from a screw supply to the screw driver bit. The screw feeder includes a swing arm assembly that is rotatable between a screw feeding position, at which the screws are removed from the supply, to a screw installing position, at which the screws are driven into a flat surface, or the like. The swing arm assembly includes a pair of opposing swing arms and a rotatable cam therebetween to control the separation and closing of the swing arms and the grasping and removing of the screws from the supply. The screws are carried on a spirally wound bandolier that is loaded within and removable from a storage drum.

21 Claims, 5 Drawing Sheets

AUTOMATIC SCREW FEEDER

BACKGROUND OF THE INVENTION

1. Field of the Invention

This invention relates to a relatively low cost and easy to use automatic screw feeder that is removably attached to a conventional electric screw driver so that a series of screws may be successively and automatically grasped and removed from a screw storage drum to be repositioned in axial alignment with the screw driver bit for installation at a wall or similar surface, but without requiring any modification to the screw driver.

2. Background Art

As will be known to workmen in the construction industry and do-it-yourselfers, alike, installing a large number of screws can be both a cumbersome and time consuming process even if accomplished with the aid of a pneumatic or electric screw driver having an appropriate screw driver bit. For example, the workman must pick out screws, one at a time, from a supply, position and hold the screw in alignment with the bit, and avoid possible injury during installation. The continuous relocation of the screws from their supply to the screw driver can become very tedious. Moreover, the screws may be dropped, lost, or mishandled. Consequently, the cost and efficiency of installation are adversely effected such that the quality of the job may suffer.

In this regard, it has been known in the past to use an automatic screw handling device in combination with a pneumatic or electric screw driver to feed screws from a screw supply to a screw driver bit. However, such devices are generally complex and relatively hard to use. In addition, the prior devices often require that some modification first be made to the existing screw driver. Consequently, the cost for using conventional screw handling devices is undesirably increased as is the skill necessary for proper assembly.

With the foregoing in mind, it would be desirable to have available a low cost, easy to use screw feeder that would require no special skill or assembly so as to be easily attached to most commercially available pneumatic or electric screw drivers for automatically feeding a large number of screws from a storage drum to a screw driver bit for efficient installation at the work site.

Examples of conventional screw handling devices are available by referring to the following United States patents:

| | |
|---|---|
| 4,146,071 | March 27, 1979 |
| 4,517,863 | May 21, 1985 |
| 4,667,545 | May 26, 1987 |
| 5,027,679 | July 2, 1991 |
| 5,083,483 | January 28, 1992 |

SUMMARY OF THE INVENTION

In general terms, this invention relates to an automatic screw feeder that may be easily coupled to a commercially available pneumatic or electric screw driver having a screw driver bit. The screw feeder has a slide assembly including a slide that is moved reciprocally through a hollow chamber to compress and expand a normally relaxed spring. Moving with the slide is a pair of cam rods which project laterally therefrom. An arming rod assembly is interconnected with the slide assembly such that a pushing force applied to the arming rod assembly (e.g. when a screw is being installed into a wall) is transferred to the slide assembly to move the slide rearwardly through the chamber and thereby compress the spring. The slide assembly is also interfaced with a swing arm assembly which includes a pair of outstretched and opposing swing arms, each having a screw retaining jaw at one end thereof. The swing arms are bent outwardly and away from one another to define a cam seat therebetween within which to receive a jaw opening cam. The opposite ends of the swing arms are interconnected with a pair of curved swing arm side plates that are pivotally secured at the screw feeder by means of an elongated pivot pin.

In operation, the rearward movement of the cam rods with the slide of the slide assembly in response to a pushing force applied to the arming rod assembly causes the return spring to be compressed and the cam rods to ride over respective cam surfaces of the swing arm side plates. As a result, the swing arm side plates are rotated downwardly around their pivot pin so as to correspondingly rotate the swing arm assembly downwardly from a screw driving position (at which a screw is installed) to a screw feeding position (at which a new screw is grasped off a bandolier that is stored within a drum). At the conclusion of the pushing force applied to the arming rod assembly, the spring of the slide assembly expands and the slide is driven forwardly through its chamber. The cam rods which are carried by the slide are, likewise, moved in a forward direction for causing the swing arm side plates of the swing arm assembly to rotate upwardly around the pivot pin. Accordingly, the swing arm assembly, which has grasped a screw from the screw drum, rotates upwardly from the screw feeding position to the screw driving position at which the screw is positioned in axial alignment with the bit of the screw driver for quick and easy installation into the wall.

A jaw opening cam is received in the cam seat of the swing arm assembly to cause the opposing swing arms thereof to open during the downward rotation of the swing arm assembly towards the screw feeding position for the purpose of grasping a screw between a pair of screw retaining jaws. However, the swing arms will remain closed around the screw during the entire upward rotation of the swing arm assembly to the screw driving position at which the screw is installed.

DETAILED DESCRIPTION

Figure 1:
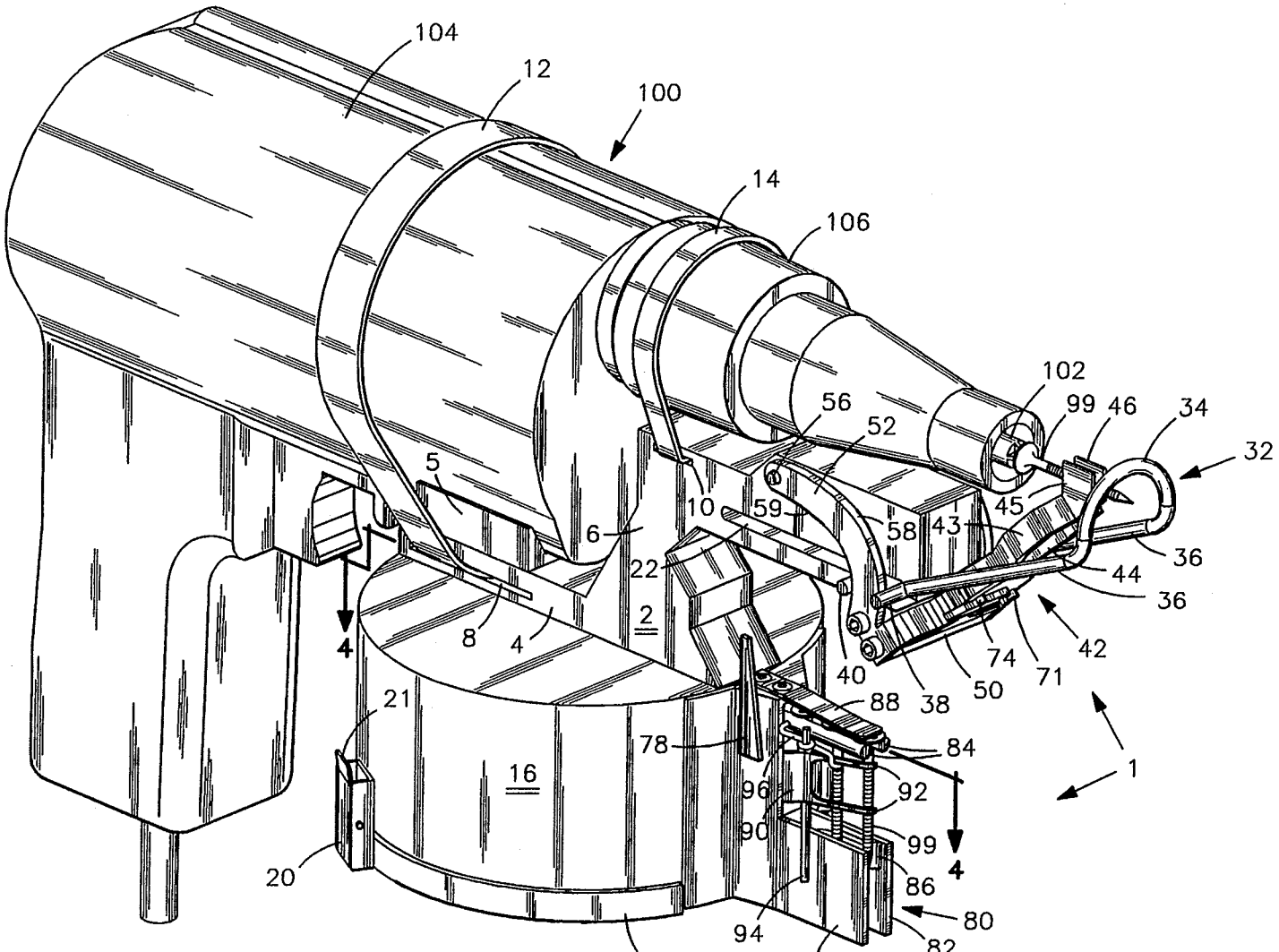
FIG. 1 is a perspective view illustrating a conventional electric screw driver showing the automatic screw feeder of the present invention coupled thereto in a screw installing position.

The automatic screw feeder 1 which forms the present invention is now described while referring to the drawings, where FIG. 1 shows the screw feeder 1 coupled to an electric screw driver. The screw feeder 1 is adapted to be coupled to most commercially available pneumatic or electrically powered screw drivers having a standard screw driver bit. By way of example only, the screw feeder 1 shown in FIG. 1 is coupled to a reversible electric screw driver 100 manufactured by Milwaukee Tool Corporation.

The screw feeder 1 includes a housing 2 having a longitudinally extending block 4 running along the bottom thereof and a swing arm support body 6 at the top. Each of the block 4 and the swing arm support body 6 has a slot 8 and 10 that is sized to receive a respective band 12 and 14 therethrough. The bands 12 and 14 are preferably manufactured from a lightweight flexible material having a high tensile strength, such as aluminum, or the like. A first of the bands 12 extends through a relatively long slot 8 in block 4 and around the motor housing 104 of screw driver 100 for attaching the screw feeder 1 to the screw driver. The band 12 has a conventional clasp (now shown) by which to hold the opposing ends thereof together while permitting the tension of the band around the drill 100 to be selectively adjusted depending upon the size and shape of the drill. The other band 14 extends through a relatively short slot 10 in swing arm support body 6 and around the clutch assembly 106 of screw driver 100 for locating the soon-to-be-described swing arm assembly (designated 42 in FIG. 6) in suitable alignment with the existing screw driver bit 102 of the screw driver. Locator band 14 also has a conventional clasp (not shown) by which to hold the opposing ends thereof together while permitting the tension of the band to be selectively adjusted.

In the assembled configuration of FIG. 1, the block 4 of housing 2 includes a curved spacer 5 that serves as a registering device to receive and support the bottom of the motor housing 104 of screw driver 100. To this end, a plurality of automatic screw feeders similar to that described herein may be made available with spacers of different heights and configurations to accommodate screw drivers of various sizes from different manufacturers. The bottom face of block 4 is affixed (e.g. by means of screws, or the like) to a metallic storage drum or screw canister 16. As will be disclosed in greater detail when referring to FIGS. 4 and 5, the drum 16 is sized to receive a supply of screws 99 that are carried on a spirally wound tape bandolier (designated 120 in FIGS. 4 and 5). The drum 16 has a lower lid 18 that may be rotated downwardly to permit access to the interior of the drum for inserting a new bandolier carrying a fresh supply of screws to be fed, one at a time, from the drum 16 into axial alignment with the screw driver bit 102 of the screw driver 100. A catch 20 having a push-down release tab 21 is located along one side of the drum 16 to releasably retain the lid 18 in the closed position along the bottom of drum 16.

Figure 3:
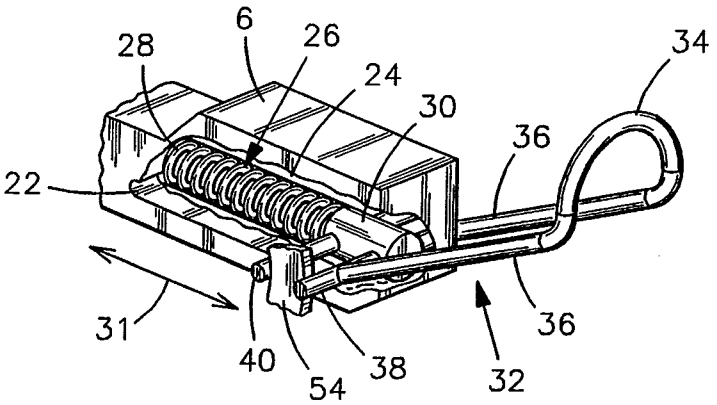
FIG. 3 shows the interconnection of a slide assembly and arming rod assembly to which a force is applied and removed for causing the screw feeder to move between the screw installing position of FIG. 1 and the screw feeding position of FIG. 2.

A longitudinally extending guide slot 22 is formed at each side of the swing arm support body 6 of housing 2 of the screw feeder 1. Referring concurrently now to FIGS. 1 and 3 of the drawings, the guide slots 22 are shown communicating with a hollow chamber 24 located at the interior of the swing arm support body 6 within which to accommodate a slide assembly 26. As is best shown in FIG. 3, the slide assembly 26 includes a normally relaxed return spring 28 having a series of coils which extend longitudinally through chamber 24 at the interior of swing arm support body 6. The forward end of return spring 28 is mated to a slide 30 that is adapted to move linearly and reciprocally through chamber 24 (in the direction of reference arrow 31) as return spring 28 is compressed and expanded. The slide 30 is interconnected with an arming rod assembly 32 in a manner that will now be described while continuing to refer to FIGS. 1 and 3.

The arming rod assembly 32 includes a wall guard 34 which is located at the forward-most end of screw feeder 1 in order to engage a wall or other surface into which a screw will be driven so as to generate an opposite pushing force for correspondingly driving the slide 30 of slide assembly 26 rearwardly through chamber 24 to thereby compress return spring 28. First ends of a pair of parallel aligned arming rods 36 are coextensively connected to the wall guard 34, and the wall guard turns upwardly therefrom. The opposite ends of the arming rods 34 are connected to a first cam 38 which, in the preferred embodiment, is a cylindrical rod that extends laterally through the slide 30 of slide assembly 26 in perpendicular alignment with spring 28. Spaced rearwardly from cam rod 38 is a second cam 40 which is also a cylindrical rod extending laterally through the slide 30.

The first and second cam rods 38 and 40 project outwardly from the slide 30 of slide assembly 26 and extend through the guide slots 22 at opposite sides of swing arm support body 6 so as to cooperate with the swing arm assembly 42 of screw feeder 1. As will be explained in greater detail hereinafter, the cam rods 38 and 40 ride through the guide slots 22 such that the linear movement of the slide 30 through chamber 24 is converted by the action of the cam rods 38 and 40 into a rotational movement of the swing arm assembly 42 by which to reposition a screw 99 from the tape bandolier 120 within drum 16 into axial alignment with the screw driver bit 102 of screw driver 100.

Figure 6:
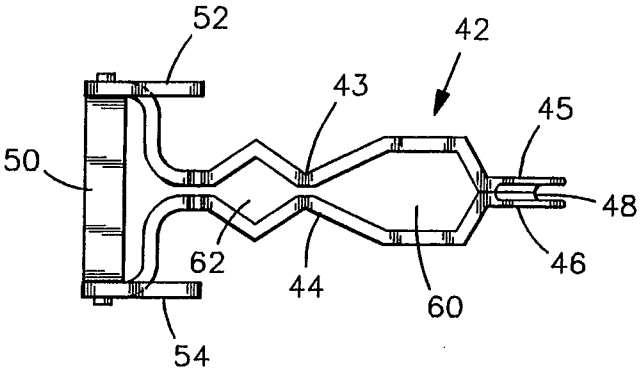
FIG. 6 shows the details of a swing arm assembly for grasping and repositioning a screw in axial alignment with the screw driver.
Figure 9:
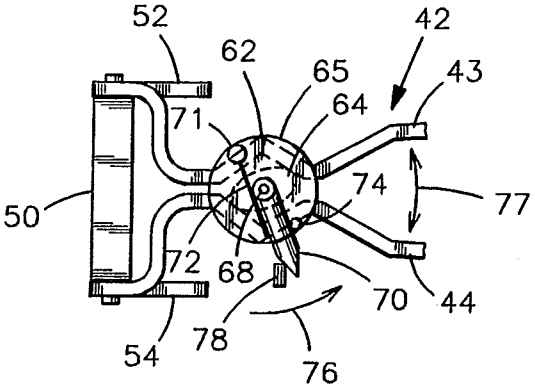

In this regard, details of the swing arm assembly 42 of screw feeder 1 are now provided while referring concurrently to FIGS. 1 and 6 of the drawings. Swing arm assembly 42 includes a pair of opposing swing arms 43 and 44 that are normally held together and adapted to grasp and then move successive screws 99 from the bandolier 120 within drum 16 into axial alignment with the screw driver bit 102 for installation in a wall or similar surface. First ends of the pair of swing arms 43 and 44 terminate at respective jaws 45 and 46 which are normally closed together to define a narrow screw seat 48 at which to grip and retain a screw 99 that is carried on the tape bandolier 120 in drum 16. The opposite ends of the pair of swing arms 43 and 44 are affixed (e.g. by means of arm screws) to opposing sides of a swing arm spacer block 50 such that the swing arms are cantilevered outwardly therefrom. The pair of swing arms 43 and 44 of swing arm assembly 42 are preferably manufactured from a metallic material having a slightly flexible characteristic to permit the arms to be separated from one another to correspondingly open the jaws 45 and 46 to grasp a screw therebetween in a manner that will be described when referring to FIGS. 7–10.

The swing arm assembly 42 also includes a pair of identically curved swing arm side plates 52 and 54. First ends of the pair of swing arm side plates 52 and 54 are affixed (e.g. by means of arm screws) to the swing arm spacer block 50. As shown in FIG. 1, the swing arm side plates 52 and 54 are coextensively connected to respective swing arms 43 and 44, although it is within the scope of this invention that the side plates 52 and 54 and swing arms 43 and 44 be separated from one another and independently connected to spacer block 50. The opposite ends of the swing arm side plates 52 and 54 are pivotally connected to an elongated pivot pin 56 that extends laterally through a hole formed in the swing arm support body 6 of housing 2. Each of the curved swing arm side plates 52 and 54 has upper and lower arcuate shaped and parallel aligned cam surfaces 58 and 59, the advantage of which will now be described.

In the assembled relationship, best shown in FIG. 1, the swing arm side plates (only one of which 52 being visible) are received between and captured by the first and second cam rods 38 and 40 of the arming rod assembly 32 (of FIG. 3). The reciprocal movement of the slide 30 of slide assembly 26 (also of FIG. 3) through the chamber 24 at the interior of the swing arm support body 6 is imparted to the cam rods 38 and 40 which project from the slide 30 to cause cam rods 38 and 40 to correspondingly slide through the guide slots 22 at opposite sides of the swing arm support body 6. The reciprocal movement of cam rods 38 and 40 through guide slots 22 is, in turn, imparted to the swing arm side plates (e.g. 54) of swing arm assembly 42. Therefore, a pushing force exerted on the slide assembly 26 from the wall guard 34 and arming rods 36 of arming rod assembly 32 will cause an identical force to be applied to the swing arm side plates 52 and 54, whereupon to cause the side plates 52 and 54 to pivot around the elongated pivot pin 56.

More particularly, as cam rods 38 and 40 slide through guide slots 22, the cam rods will ride over respective upper and lower cam surfaces 58 and 59 of the swing arm side plates 52 and 54. By way of example, when a screw is being driven into a wall, a rearward pushing force is directed to the swing arm assembly 42 via the wall guard 32 of arming rod assembly 32 and the slide assembly 26 (to push the slide 30 and compress the return spring 28 of slide assembly 26). In response to the rearward force applied to the swing arm assembly 42, the first cam rod 38 will be moved rearwardly so as to impact the swing arm side plates 52 and 54 along the respective upper cam surfaces 58 thereof. Accordingly, the swing arm side plates 52 and 54 will be rotated downwardly and towards the screw carrying drum 16 from their at rest or screw installing position of FIG. 1 to their screw feeding position (shown in solid lines in FIG. 2) at which to grasp and remove another screw 99 from the bandolier of drum 16 in a manner that will soon be disclosed.

When the previously applied rearward force is removed from the swing arm assembly 42, such as after the screw has been installed and the wall guard 34 of arming rod assembly 36 is moved away from the wall, the return spring 28 of slide assembly 26 will automatically expand towards its normal pre-stressed condition, whereby to move the slide 30 in a forward direction through the chamber 24 of swing arm support body 6. In response to the removal of the aforementioned rearward force from the swing arm assembly 42, the second cam rod 40 will move forwardly with slide 30 so as to impact the swing arm side plates 52 and 54 along the respective lower cam surfaces 59 thereof. Accordingly, the swing arm side plates 52 and 54 will be rotated upwardly around pivot pin 56 from the screw feeding position of FIG. 2 to the screw driving position of FIG. 1, whereby to position the screw 99 that was removed from the drum 16 during the downward rotation of swing arm assembly 42 in axial alignment with the screw driver bit 102 of screw driver 100.

Referring once again to the swing arm assembly 42 illustrated in FIG. 6, it is important to note that the opposing swing arms 43 and 44 thereof project away from one another at two locations so that a clearance opening 60 and a cam seat 62 are established in the gaps therebetween. In particular, and turning now to FIGS. 7–10 of the drawings, the manner in which the jaws 45 and 46 open to first grasp and then reposition a screw 99 during the previously described downward and upward rotations of the swing arm assembly 42 are now disclosed.

Figure 7:
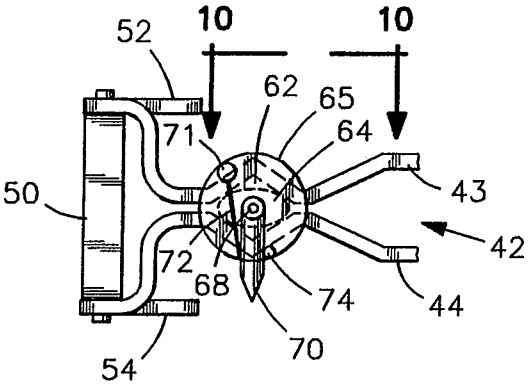

Referring initially to FIG. 7, an elliptically shaped jaw opening cam 64 is shown seated within the cam seat 62. To accommodate the elliptical opening cam 64, the opposing swing arms 43 and 44 of swing arm assembly 42 angle outwardly and in opposite directions to define a generally diamond-shaped cam seat 62. The opening cam 64 is enclosed within the cam seat 62 by means of outside and inside cam disks 65 and 66 (best shown in FIG. 10) which are attached to opposite sides of and adapted to rotate with cam 64. A pawl pivot pin 68 penetrates the outside and inside cam disks 65 and 66 to pivotally support the jaw opening cam 64 for rotation within cam seat 62. However, in its at rest position shown in FIG. 7, the cam 64 is stationary and extends between longitudinally opposed corners of the diamond-shaped cam seat 62.

An elongated pawl 70 is attached to the outside cam disk 65 by pivot pin 68 so as to be rotatable over cam disk 65 in response to an impact force applied to the pawl 70. Affixed to outside cam disk 65 adjacent a first side of pawl 70 is a spring post 71. The spring post supports a flat, flexible pawl spring 72 which has a spring-like memory and engages the first side of the pawl 70. Also affixed to the outside of cam disk 65 adjacent the opposite side of pawl 70 is a pawl stop post 74 which engages the opposite side of the pawl 70. Thus, at its at rest position shown in FIG. 7, the pawl 70 is positioned between the pawl spring 72 and the pawl stop post 74, such that a rotation of pawl 70 around pivot pin 68 in a clockwise direction and towards pawl spring 72 (represented by the reference arrow 75 shown in FIG. 8) will cause the pawl spring 72 to bend.

Since pawl spring 72 is independent of the outside cam disk 65, the entire pushing force applied by pawl 70 will be absorbed by the spring 72, and no force will be exerted upon the outside cam disk 65 when the pawl 70 rotates in the clockwise direction, such that outside cam disk 65 remains stationary. Being that the outside cam disk 65 will remain stationary, the jaw opening cam 64 that is attached to cam disk 65 will likewise remain stationary and in its at rest position of FIG. 7 extending between longitudinally opposing corners of cam seat 62. Therefore, the positions of the opposing swing arms 43 and 44 of swing arm assembly 42 will be unchanged and the respective jaws thereof (designated 45 and 46 in FIG. 6) remain closed.

However, in the event that the pawl 70 rotates around pivot pin 68 in an opposite, counter-clockwise direction (represented by the reference arrow 76 shown in FIG. 9), the pawl 70 will move towards and into contact with the stop post 74 which is fixedly connected to outside cam disk 65. In the case of the counter-clockwise rotation of pawl 70, a pushing force is applied to stop post 70, which force is imparted via post 70 to outside cam disk 65 to correspondingly cause the cam disk 65 to rotate in the same counter-clockwise direction. The rotation of outer cam disk 65 is transmitted to the jaw opening cam 64 within cam seat 62 between the swing arms 43 and 44 of swing arm assembly 42. Accordingly, the jaw opening cam 64 will rotate out of its at rest position of FIG. 7 to its unseated position of FIG. 9. A rotation of cam 64 in cam seat 62 will force the opposing swing arms 43 and 44 of swing arm assembly 42 to separate and move away from one another in opposite directions as indicated by the reference arrow 77 of FIG. 9. As the swing arms 43 and 44 separate, their respective jaws (designated 45 and 46 in FIG. 6) will likewise open.

Figure 2:
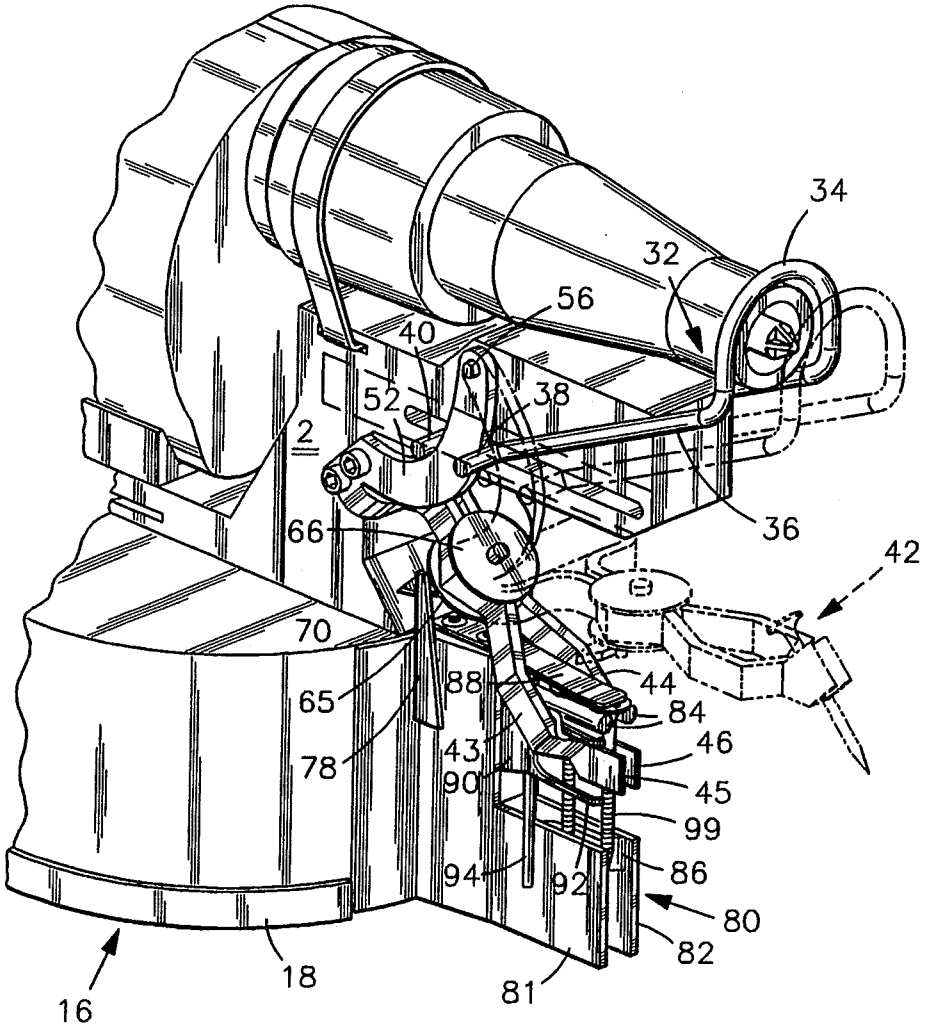
FIG. 2 shows the automatic screw feeder of FIG. 1 coupled to the electric drill and moving to a screw feeding position.

The generation of the pushing forces which cause pawl 70 to rotate in either a clockwise direction and into contact with spring 72 (during which outside cam disk 65 remains stationary and swing arms 43 and 44 remain closed) or a clockwise direction and into contact with pawl stop post 74 (during which the outside cam disk 65 also rotates and swing arms 43 and 44 separate from one another) is now explained. Referring to FIG. 2 of the drawings, the screw drum 16 is shown having a keeper housing 80 extending forwardly thereof. The keeper housing 80 includes a pair of spaced, parallel aligned side plates 81 and 82. Projecting upwardly and above the keeper housing 80 from one of the side plates (e.g. 81) is an opening cam trip lever 78, the function of which is to apply opposing pushing forces required to rotate the pawl 70 in either clockwise or counter-clockwise directions (illustrated in FIGS. 8 and 9) in order to control the opening and closing of the jaws 45 and 46 of swing arm assembly 42 in the manner previously disclosed.

That is, as the swing arm assembly 42 is rotated downwardly (i.e. in response to a pushing force applied to the wall guard 34 of arming rod assembly 32) towards the screw feeding position (shown in solid lines in FIG. 2), the pawl 70 is carried downwardly therewith. The cam trip lever 78 is positioned to lie within the path of pawl 70. Thus, during the downward stroke of swing arm assembly 42 from the screw installing position of FIG. 1 towards the screw feeding position of FIG. 2, the cam trip lever 78 will strike and push the pawl 70 in the counter-clockwise direction and into contact with the stop post 74 (best shown in FIG. 9). As was previously described when referring to FIG. 9, the counter-clockwise rotation of pawl 70 into post 74 causes a corresponding rotation of the outside cam disk 65 and the jaw opening cam 64 attached thereto. Therefore., as the swing arm assembly 42 approaches the screw feeding position, the swing arms 43 and 44 are separated from one another and the jaws 45 and 46 are opened so that a new screw from drum 16 may be received therebetween.

At the very bottom of the downstroke when swing arm assembly 42 finally reaches the screw feeding position of FIG. 2, the pawl 70 will snap past the upstanding cam trip lever 78 to return to its at rest position of FIG. 7. More particularly, the impact of the trip lever 78 during the downstroke will initially cause the pawl 70 and cam disk 65 to rotate simultaneously in a counter-clockwise direction such that the pawl 70 is biased to slide past trip lever 78 as the swing arm assembly 42 approaches the very bottom of its downstroke. At this point, the force previously applied by opening cam 64 for separating the opposing swing arms 43 and 44 will be discontinued, thereby permitting the swing arm assembly 42 to automatically return to its at rest position (shown in FIG. 7) where the jaws 45 and 46 thereof will close to grasp and retain a screw 99 therebetween, as shown in solid lines at FIG. 2.

During the beginning of the upstroke when swing arm assembly 42 rotates towards the screw installing position of FIG. 1 with a screw 99 grasped between jaws 45 and 46, the cam trip lever 78 will once again strike the pawl 70. In this case, the pawl 70 is pushed in the clockwise direction against the pawl spring 72 (best shown in FIG. 8). As was previously described when referring to FIG. 8, the clockwise rotation of pawl 70 into spring 72 will cause the spring to bend and absorb the pushing force applied thereto by the pawl 70. However, the outside cam disk 65 and the jaw opening cam 64 will not rotate during the upstroke, such that the swing arms 43 and 44 of swing arm assembly 42 will not separate, whereby jaws 45 and 46 remain closed around the screw. The pawl 70 continues to push against the pawl spring 72 until the pawl slides past trip lever 78 as the swing arm assembly 42 rotates upwardly towards the screw installing position of FIG. 1. At this point, the pawl 70 snaps back to its at rest position of FIG. 7 leaving the screw 99 firmly retained between the jaws 45 and 46 of swing arm assembly 42 for rotation therewith to the screw installing position of FIG. 1 and into axial alignment with the screw driver bit 102 of the screw driver 100.

It should be appreciated that by virtue of the foregoing, the swing arms 43 and 44 will be separated and the jaws 45 and 46 thereof will open only during the downward rotation of the swing arm assembly 42 towards the screw feeding position. Once a screw 99 from drum 16 has been received by swing arm assembly 42 at the very bottom of a downstroke, the swing arms 43 and 44 will move together and the jaws 45 and 46 will close to grasp and retain the screw. During the entire upstroke of the swing arm assembly to the screw driving position, the swing arms 43 and 44 will remain together and the jaws 45 and 46 will stay closed so that the screw 99 will neither be dropped nor misaligned.

Figure 11:
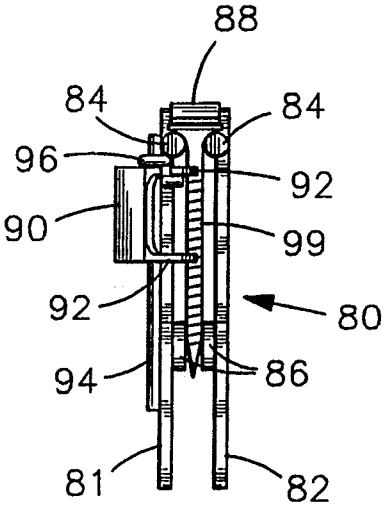

The means by which a screw 99 is grasped and removed from the bandolier 120 at the bottom of the downstroke of the swing arm assembly 42 is now described while referring initially to FIGS. 1, 2 and 11 of the drawings. As was previously disclosed, a pair of keeper side plates 81 and 82 from the keeper housing 80 projects forwardly from the screw storage drum 16. The screws 99 which are stored in the drum 16 and carried on the bandolier 120 are moved, one after another, to a screw grasping position between the side plates 81 and 82 of keeper housing 80. More particularly, a pair of parallel keeper side rails 84 are spaced above the side plates 81 and 82 to support the heads of the screws 99 and guide the screws carried on the bandolier 120 from the drum 16 to the screw grasping position at the forward end of the keeper housing 80. A pair of shaft snuggers 86 are positioned in spaced opposing alignment with one another inside respective keeper side plates 81 and 82 so as to engage the shafts of the screws 99 moving between the plates 81 and 82. A head snugger 88, which is preferably a thin strip of flexible metal, one end of which is affixed by rivets to the keeper housing 80, projects outwardly and over top the keeper side plates 81 and 82 so as to press the heads of the screws 99 downwardly against the keeper side rails 84. It may be appreciated that the keeper side rails 84, shaft snuggers 86 and head snugger 88 cooperate with one another by engaging the head and shaft of each screw 99 to maintain the proper alignment of such screw during movement to the screw grasping position between keeper side plates 81 and 82 for receipt by swing arm assembly 42.

The keeper housing 80 also includes a keeper flap 90 which has a pair of spaced, parallel aligned prongs or fingers 92 projecting outwardly therefrom, one above the other. The keeper flap 90 is coupled to and rotatable around a keeper pin 94 by means of a longitudinally extending pivot surface (not shown) formed at the underside of flap 90. The keeper pin 94 is affixed (e.g. brazed) to the keeper side plate 81. A keeper spring 96 consisting of a short metal wire, or the like, having a spring memory is wrapped around keeper pin 94. One end of the keeper spring 96 bends around and is thereby attached to one of the prongs 92 of the keeper flap 90 to control the rotation of the keeper flap 90 as will now be described while referring to FIGS. 1, 2, 12 and 13 of the drawings.

Figure 12:
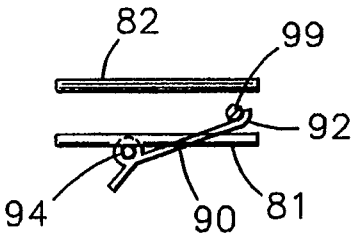

As is best shown in FIGS. 1 and 12, when the swing arm assembly 42 is in the screw installing position (of FIG. 1), the keeper flap 90 of keeper housing 80 is rotated by spring 96 around the keeper pin 94 until the prongs 92 of flap 90 engage the forward-most screw 99 that is carried on the bandolier 120. Thus, any removal of the screw 99 from the keeper housing 80 is blocked by the prongs 92. That is, in the screw driving position, the keeper spring 96 biases the keeper flap 90 by pushing the prongs 92 thereof into engagement with the forward-most screw 99 on bandolier 120.

Figure 13:
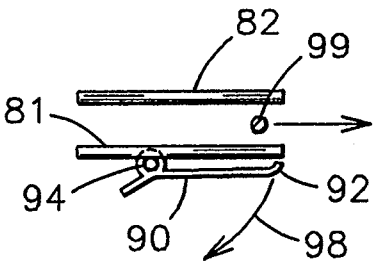
FIGS. 11–13 shows details of a screw feeding keeper assembly by which a screw is positioned to be grasped and removed from the bandolier by means of the aforementioned swing arm assembly.

Referring now to FIGS. 2 and 13, when the swing arm assembly 42 is moved downwardly to the screw feeding position (shown in solid lines in FIG. 2), a force is exerted on the keeper flap 90 to cause the prongs 92 thereof to rotate (in the direction of the reference arrow designated 98 in FIG. 13) against the bias of keeper spring 96 and out of engagement with the forward-most screw 99. More particularly, and referring briefly once again to FIG. 6, the swing arm assembly 42 was described as having a clearance opening 60 and a cam seat 62 formed between a pair of opposing swing arms 43 and 44. A jaw opening cam 64 is seated within and rotatable relative to the cam seat 62. The clearance opening 60 is particularly sized to receive therethrough the keeper side rails 84, the head snugger 88 and the keeper flap 90 of keeper housing 80 to permit the swing arm assembly 42 to rotate downwardly to the screw feeding position of FIG. 2. That is to say, clearance opening 60 avoids any obstruction by keeper housing 80 to swing arm assembly 42 arriving at the bottom of its down stroke. Moreover, in the screw feeding position of FIG. 2, the shaft of the forward-most screw 99 on bandolier 120 is located at the designated position to be grasped at the screw seat 48 of swing arm assembly 42 between the opposing jaws 45 and 46 thereof.

When the swing arm assembly 42 approaches the bottom of its down stroke, one of the swing arms (e.g. 43) strikes the keeper flap 90 to thereby cause flap 90 and the prongs 92 extending therefrom to rotate around the keeper pin 94 and against the bias of keeper spring 96. Accordingly, as shown in FIG. 13, the prongs 92 of keeper flap 90 disengage the forward-most screw 99 to permit such screw (which is now retained between the jaws 44 and 46 of the swing arm assembly 42) to be removed from the keeper housing 80. Therefore, as the swing arm assembly 42 starts to rotate in the upward direction (represented by phantom lines in FIG. 2), the forward-most screw 99 will be pulled off the bandolier 120 and relocated with swing arm assembly 42 to the screw installing position of FIG. 1. At the same time that the forward-most screw 99 is pulled off the bandolier 120, the pulling action applied by swing arm assembly 42 simultaneously advances the bandolier, whereby to move the next screw carried thereon into position as the new forward-most screw between the keeper side plates 81 and 82 so as to be in position to be grasped and removed during the next stroke cycle of swing arm assembly 42.

The upward rotation of swing arm assembly 42 with a screw 99 towards the screw driving position results in a termination of the striking force which was previously applied by one of the swing arms 43 to the keeper flap 90. Therefore, with swing arm 43 moved away from and out of contact with keeper flap 90, the memory of the keeper spring 96 will cause the keeper flap 90 to automatically rotate around keeper pin 94 until the prongs 92 engage the new forward-most screw on the bandolier (in the manner described when referring to FIG. 12). The prongs 92 will, once again, prevent the removal of such screw from the keeper housing 80 until the following downward rotation of the swing arm assembly 42 to the screw feeding position and the corresponding rotation of keeper flap 90.

Figure 4:
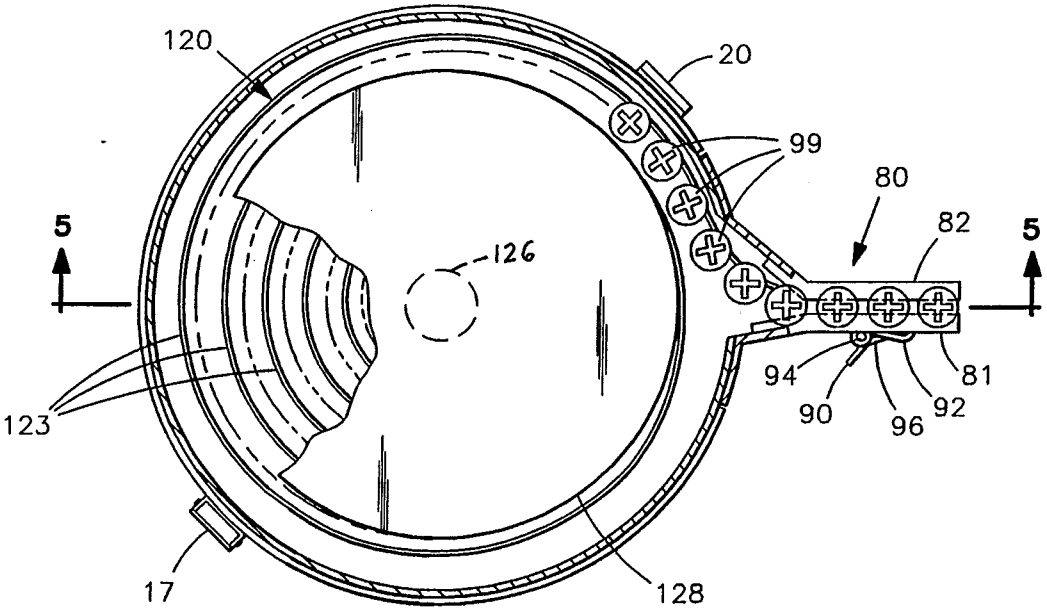
FIGS. 4 and 5 illustrate a drum of the screw feeder in which is stored a supply of screws that are carried on a rolled up bandolier.
Figure 5:
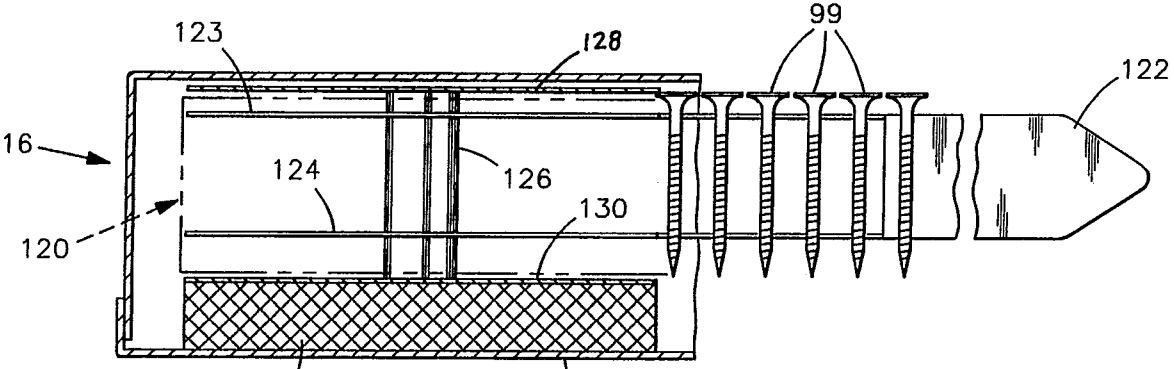
Figure 8:
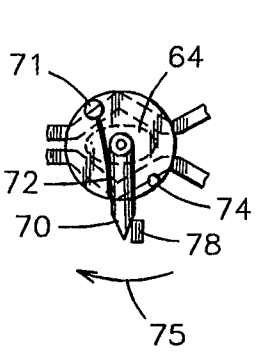
FIGS. 7–10 illustrate the operation of a jaw opening cam for causing the swing arm assembly of FIG, 6 to grasp and remove a screw that is carried on the bandolier within the screw drum of FIGS. 4 and 5.
Figure 10:
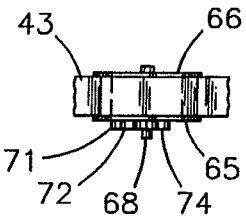

FIGS. 4 and 5 of the drawings illustrate the details of the bandolier 120 which is wound up and stored at the interior of the drum 16 with a supply of screws 99 carried thereon. More particularly, the bandolier 120 includes a feeding tab 122 at the forward end thereof by which the screws 99 are initially pulled out from drum 16 and positioned between the keeper side plates 81 and 82 of keeper housing 80 to await removal during the stroke cycle of the swing arm assembly 42, as previously disclosed. Once the screws 99 are initially positioned between side plates 81 and 82, as shown in FIG. 4, the feeding tab 122 of bandolier 120 is torn off and discarded.

Behind the feeding tab 122, the bandolier includes a pair of spaced, parallel aligned screw binding strips 123 and 124. Binding strips 123 and 124 are preferably thin strips made from paper or other easily breakable material which allows the screws 99 to be successively torn off during each upward rotation of the swing arm assembly 42 towards the screw installing position. To this end, the shafts of the screws 99 are affixed to the binding strips 123 and 124 by means of a suitable adhesive. The binding strips 123 and 124 with the screws 99 affixed thereto are helically wound around a central core 126. Top and bottom retainer disks 128 and 130 are attached to opposite ends of the core 126 to enclose the wound binding strips 123 and 124. Thus, bandolier 120 has the attributes of a disposable/replaceable screw cartridge. In this manner, when the original screw supply is exhausted, the bandolier may be removed from the drum 16 and replaced by a fresh supply of screws that is carried by a new bandolier. The foregoing is easily achieved by operating the latch 20 to cause the lower lid 18 of drum 16 to rotate downwardly along hinge 17 and thereby permit access to the interior of drum 16 for inserting or removing the bandolier 120.

With a bandolier loaded in the storage drum 16, a packing block 132 may also be loaded into the drum 16 to support the rolled bandolier 120. The packing block 132 is typically formed from a lightweight filler or foam material and is used when the bandolier 120 carries screws of relatively short length (as shown herein). That is to say, a variety of bandoliers which carry screws of different lengths are contemplated, such that a packing block 132 may be avoided when a bandolier (not shown) that carries relatively long screws is to be loaded within the storage drum 16.

It will be apparent that while a preferred embodiment of the invention has been shown and described, various modifications and changes may be made without departing from the true spirit and scope of the invention. For example, it is to be expressly understated that the apparatus disclosed herein is also adopted to feed and position headed fasteners other than screws such as, but not limited to, bolts, rivets and the like. Having thus set forth the preferred embodiment of this invention, what is claimed is:

I claim:

1. Apparatus coupled to a power tool to automatically feed fasteners to said tool for installation, said apparatus comprising means by which to store a supply of fasteners and a swing arm assembly rotating between a feeding position at which to remove a fastener from said supply means to an installing position at which the fastener is installed by said tool, said swing arm assembly having means by which to grasp and retain the fastener removed from said supply means and at least one swing arm to carry said fastener grasping and retaining means, said swing arm having first and second cam surfaces located at respective first and opposite sides thereof, said apparatus further comprising cam actuating means to engage said first cam surface at the first side of said swing arm to cause said swing arm assembly to rotate from said feeding position to said installing position or to engage said second cam surface at the opposite side of said swing arm to cause said swing arm assembly to rotate from said installing position to said feeding position.

2. The apparatus recited in claim 1, further comprising a housing detachably connected to said power tool and means by which to pivotally connect said swing arm assembly to said housing such that such swing arm assembly is rotatable around said pivot means between said feeding and installing positions.

3. The apparatus recited in claim 2, wherein said housing is detachably coupled to said power tool by means of at least one flexible band connected to said housing and extending around said tool.

4. The apparatus recited in claim 2, wherein said cam actuating means includes first and second cam rods moving reciprocally through said housing, the swing arm of said swing arm assembly extending between said cam rods such that the first cam surface of said swing arm is engaged by a first of said cam rods for causing said swing arm assembly to rotate from said feeding position to said installing position when said cam rods move in a first direction through said housing, and the second cam surface of said swing arm engaged by the second of said cam rods for causing said swing arm assembly to rotate from said installing position to said feeding position when said cam rods move in an opposite direction through said housing.

5. The apparatus recited in claim 4, wherein said first and second cam surfaces are aligned parallel with each other at opposite sides of said swing arm.

6. The apparatus recited in claim 4, further comprising a hollow chamber formed at the interior of said housing, said first and second cam rods projecting outwardly from and moving reciprocally through said chamber to engage respective cam surfaces of said swing arm for causing said swing arm assembly to rotate between the feeding and installing positions.

7. The apparatus recited in claim 6, further comprising a slide assembly moving reciprocally through said hollow chamber and carrying said first and second cam rods therewith, and a compression spring which is alternately compressed and expanded as said slide assembly moves in opposite directions through said chamber.

8. The apparatus recited in claim 7, further comprising an arming rod assembly interconnected with said slide assembly, said arming rod assembly responsive to a pushing force applied thereagainst to cause said slide assembly and said cam rods carried thereby to move in a first direction through said hollow chamber during which said spring is compressed, said spring expanding to cause said slide assembly and said cam rods to move in the opposite direction through said housing when the pushing force is removed from said arming rod assembly.

9. The apparatus recited in claim 1, wherein said swing arm assembly includes a pair of opposing swing arms, each of said swing arms carrying a jaw at one end thereof, said jaws being closed against one another to form said means by which to grasp and retain the fastener removed from said supply means, said swing arm assembly further including means by which to open said jaws to grasp a fastener from said supply means during the movement of said swing arm assembly from the installing position to the feeding position and to close said jaws so that the fastener is retained therebetween during the movement of said swing arm assembly between the feeding position and the installing position.

10. The apparatus recited in claim 9, wherein said means by which to open and close said jaws includes cam means located between said opposing swing arms for causing said swing arms to alternately move apart and together.

11. The apparatus recited in claim 10, further comprising a cam seat formed between said opposing swing arms of said swing arm assembly for receiving said cam means therewithin, said cam means rotating within said cam seat for causing said swing arms to alternately move apart and together to thereby open and close said jaws thereof.

12. The apparatus recited in 13, further comprising rotatable stop means interconnected to said cam means, compression spring means, and rotatable pawl means located between said stop means and said spring means, said pawl means rotating in a first direction into contact with and rotating said stop means when said swing arm assembly moves from the installing position towards the feeding position to cause said cam means to rotate in said cam seat and the jaws of said swing arms to open, and said pawl means rotating in a second direction into contact with and compressing said spring means when said swing arm assembly moves from the feeding position towards the installing position, said spring means absorbing the contact force of said pawl means such that said cam means remains stationary in said cam seat and the jaws of said swing arms remain closed.

13. The apparatus recited in claim 12, further comprising a cam trip lever projecting outwardly from said housing, said cam trip lever engaging said pawl means to rotate said pawl means in said first direction into contact with said stop means when said swing arm assembly moves form the installing position towards the feeding position and to rotate said pawl means in said second direction into contact with said spring means when said swing arm assembly moves from the feeding position towards the installing position.

14. The apparatus recited in claim 1, wherein said means by which to store the supply of fasteners includes a hollow drum and a spirally wound bandolier located within said drum and having a plurality of fasteners attached thereto in spaced, parallel alignment with one another.

15. The apparatus recited in claim 14, further comprising keeper means movable into and out of engagement with the first-most fastener at the leading end of the bandolier, said keeper means moving into engagement with said first-most fastener to block the removal thereof when said swing arm assembly moves from the feeding position to the installing position, and said keeper means moving out of engagement with said first-most fastener to permit the removal thereof when said swing arm assembly moves from the installing position to the feeding position.

16. The apparatus recited in claim 15, wherein said keeper means includes at least one outstretched arm and pivot means around which to rotate to correspondingly rotate said arm into and out of engagement with said first-most fastener of said bandolier, said swing arm assembly striking said keeper means when said swing arm assembly moves towards the feeding position to cause said keeper means to rotate such that said arm moves out of engagement with said first-most fastener to permit said swing arm assembly to grasp and remove said fastener from said bandolier.

17. Apparatus coupled to a power tool to automatically feed fasteners to said tool for installation, said apparatus comprising means by which to store a supply of fasteners and a swing arm assembly movable between a feeding position at which to remove a fastener from said supply means to an installing position at which the fastener is installed by said tool, said swing arm assembly including a pair of opposing swing arms having respective normally closed jaws and cam means located between and moving relative to said swing arms to cause said swing arms to alternately move apart and together to thereby open said jaws to grasp a fastener from said supply means during the movement of said swing arm assembly from the installing position to the feeding position and to close said jaws so that the fastener is retained therebetween during the movement of said swing arm assembly between the feeding position and the installing position.

18. The apparatus recited in claim 17, wherein said means to store a supply of fasteners includes a hollow drum having a spirally wound bandolier located within said drum and removable therefrom, said bandolier carrying said fasteners in spaced, parallel alignment with one another such that the first-most fastener at the leading end of said bandolier is removed therefrom by said swing arm assembly.

19. The apparatus recited in claim 17, wherein said swing arm assembly also includes a cam seat formed at each of said opposing swing arms for receiving said cam means therebetween, said cam means rotating within said cam seats of said swing arms for causing said swing arms to alternately move apart and together to thereby open and close said jaws thereof.

20. The apparatus recited in claim 17, wherein at least one of said pair of swing arms has first and second cam surfaces located at respective first and opposite sides thereof, said apparatus further comprising cam actuating means to engage said first cam surface at the first side of said one swing arm to cause said swing arm assembly to rotate from said feeding position to said installing position or to engage said second cam surface at the opposite side of said swing arm to cause said swing arm assembly to rotate from said installation position to said feeding position.

21. The apparatus recited in claim 20, wherein said cam actuating means includes first and second cam rods moving reciprocally relative to said swing arm assembly, said at least one swing arm of said swing arm assembly extending between said cam rods such that the first cam surface of said swing arm is engaged by a first of said cam rods for causing said swing arm assembly to rotate from said feeding position to said installing position when said cam rods move in a first direction, and the second cam surface of said one swing arm is engaged by the second of said cam rods for causing said swing arm assembly to rotate from said installing position to said feeding position when said cam rods move in an opposite direction.

* * * * *